United States Patent [19]

Lack

[11] Patent Number: 4,507,990

[45] **Date of Patent: * Apr. 2, 1985**

[54] RATCHET WRENCH

[75] Inventor: Larry H. Lack, Bossier City, La.

[73] Assignees: Frank M. Auer; C. J. Auer; Paul B. Lindenmayer, all of Shreveport, La.

[ * ] Notice: The portion of the term of this patent subsequent to Jan. 24, 2001 has been disclaimed.

[21] Appl. No.: 571,196

[22] Filed: Jan. 19, 1984

Related U.S. Application Data

[63] Continuation-in-part of Ser. No. 352,182, Feb. 25, 1982, Pat. No. 4,426,895.

[51] Int. Cl.[3] ..... B25B 17/00

[52] U.S. Cl. ..... 81/57.39; 81/57.31

[58] Field of Search ..... 81/57.39, 57.31, 60, 81/61, 62, 62.1, 62.3, 125

[56] References Cited

U.S. PATENT DOCUMENTS

| | | | |
|---|---|---|---|
| 755,569 | 3/1904 | Freeland | 81/61 |
| 1,860,914 | 5/1932 | Wellman | 81/57.31 |
| 2,174,502 | 9/1939 | Rueb | 81/63 |
| 2,520,443 | 8/1950 | Seaquist | 81/57.31 |
| 2,641,136 | 6/1953 | Marsden et al. | 81/57.31 |
| 2,725,772 | 12/1955 | Stone | 81/63 |
| 3,587,364 | 6/1971 | Peyre | 81/57.39 |
| 3,828,629 | 8/1974 | Moore | 81/57.39 |
| 4,426,895 | 1/1984 | Lack | 81/57.39 |

*Primary Examiner*—James L. Jones, Jr.
*Attorney, Agent, or Firm*—John M. Harrison

[57] ABSTRACT

A ratchet wrench having a top housing and a first handle cooperating with the top housing; a bottom housing with a cooperating second handle; a ratchet drum disposed within the top housing and the bottom housing and provided with exterior teeth and a pair of side bevel gears rotatably mounted on a shaft in opposed relationship inside the ratchet drum; a top bevel gear disposed inside the top housing and extending inside the ratchet drum to engage the side bevel gears; a drive bevel gear rotatably positioned in the bottom housing opposite the top bevel gear and also engaging the side bevel gears and carrying a socket drive extending from the bottom housing; top and bottom ratchet means mounted on the first and second handles, respectively and selectively cooperating with the teeth on the ratchet drum; and pivoting handle lock means for selectively allowing the first and second handles to be manipulated as one handle or separately, to operate the ratchet wrench in a more efficient manner.

17 Claims, 6 Drawing Figures

RATCHET WRENCH

CROSS REFERENCE TO RELATED APPLICATIONS

This application is a continuation-in-part of my copending U.S. patent application, Ser. No. 06/352,182, filed Feb. 25, 1982 now U.S. Pat. No. 4,426,895, entitled "Ratchet Wrench."

BACKGROUND OF THE INVENTION

1. Field of the Invention

This invention relates to ratchet drive devices, and more particularly, to a ratchet wrench which is characterized by top and bottom handles fixedly attached to, or shaped integrally with separate housing elements to achieve a mechanical advantage in driving a socket drive extending from the bottom housing element. The split housing encloses a cylindrically shaped, hollow ratchet drum having vertically oriented, external teeth and rotatably situated in the housing. The ratchet drum contains a pair of oppositely-disposed side bevel gears rotatably mounted on a shaft fixedly mounted inside the ratchet drum and extending across the diameter of the ratchet drum and a larger top bevel gear is secured inside the top housing element and extends inside the ratchet drum to engage the side bevel gears on the shaft from the top. Similarly, a drive bevel gear, which is also larger than the side bevel gears, rotatably engages the side bevel gears from the bottom at a point on the lower housing element opposite the top bevel gear and carries a socket drive which extends from the drive bevel gear through the lower housing element to receive a socket. The respective handles and housing elements are rotatable with respect to the ratchet drum and are designed to drive the ratchet drum and the socket drive in a desired direction by operation of a top and bottom ratchet, attached to the top and bottom handles, respectively, depending upon the relative position of the ratchet pawls in engagement with the ratchet drum teeth. For example, adjustment of the ratchet pawls for engagement in a common first position in the top and bottom ratchets, respectively, facilitates rapid rotation of the socket drive in a clockwise direction when the top and bottom handles are alternately rotated in opposite directions. Conversely, when the ratchet pawls are moved into a common second position in the top and bottom ratchets, rotation of the handles in opposite directions facilitates movement of the socket drive in the counter-clockwise direction. Furthermore, with the ratchet pawls adjusted in a first common engaged position in the top and bottom ratchets, respectively, and the top and bottom handles held or locked together in parallel fashion, the ratchet wrench can be used as a conventional ratchet wrench and movement of the top and bottom handles in concert against the locked ratchet pawls drives the socket drive in a selected direction. Conversely, adjustment of the ratchet pawls in a second common direction and maintaining the top and bottom handles in alignment while rotating the handles in the opposite direction effects a rotation of the socket drive in that opposite direction. In a preferred embodiment of the invention the top and bottom handle can be secured to act in concert or released for manipulation in different directions by means of a pivoting handle lock which cooperates with the top and bottom handles.

2. Description of the Prior Art

Devices for driving bolts, lag screws and other fastening devices having heads suited for manipulation by sockets are well known in the prior art. Such devices include single and double-head wrenches, box and open end wrenches and similar tools. More sophisticated wrenches having a ratcheting function were developed to solve the problem of installing bolts and nuts and other fasteners having a square or hexagonal head configuration in cramped locations, such as in or near engines and machinery, where a conventional wrench cannot be engaged and operated in a complete circle or in a substantial arc without contacting other parts of the machine. In such application, conventional wrenches must be first engaged with the nut or bolt head, rotated to the extent possible to tighten or loosen the nut or bolt and repositioned for another sequence. The conventional ratchet wrench allows the user to adjust the ratchet pawl in the ratchet or drive drum teeth to achieve clockwise or counter-clockwise driving of the socket drive and return of the wrench handle to the initial placement position by operation of the ratchet. Such ratchet drive devices are available in a variety of sizes and are highly useful in tightening and loosening nuts and bolts.

An improved ratchet wrench is disclosed in U.S. Pat. No. 1,860,914, dated May 31, 1932, to Henry J. Wellman, which device includes a dual handle ratchet mechanism which uses a common, splined ratchet drum having interior bevel gears which mesh to provide a gear box for driving a socket drive when the handles are rotated with respect to each other. U.S. Pat. No. 3,587,364, to X. M. J. Peyre, dated June 28, 1971 discloses a wrench having two arms pivotally connected with the first arm integral with a crown gear which engages planet pinions mounted for free rotation on a planet carrier, which in turn rotates about the axis of the crown gear. The planet pinions engage a central sun gear which rotates about the axis and which is internal with the torque head of the wrench and ratchet means integral with the second arm enable locking of the planet carrier in rotation with respect to the second arm for acutation of the torque head during movement of the arms toward each other. U.S. Pat. No. 755,579, dated Mar. 22, 1904, to G. Freeland discloses a "Ratchet Wrench" which includes two handles or lever arms, cooperating spring-held dog or click, together with a ratchet head. The wrench is so designed such that when either lever arm is turned in the backward or reverse direction the dog slips over the teeth of the ratchet and the lever arms are moved in opposite directions, one arm or handle acting to turn the ratchet head while the dog of the other lever arm slips over the teeth of the ratchet, moving in the opposite direction from rotation of the head. The handles are thus turned back and forth being alternately active and idle, whereby an approximately continuous rotation of the head is effective.

It is an object of this invention to provide an new and improved, dual handle ratchet wrench which is characterized by a split housing, an interior ratchet drum provided with internal bevel gears and exterior teeth, a pair of ratchet mechanisms on the handles for selectively engaging the teeth on the ratchet drum and a pivoting handle lock for securing the handles together and operating the wrench in conventional fashion in one embodiment and allowing the handles to be separately manipulated, in another, more mechanically efficient embodiment of the invention.

Another object of this invention is to provide a new and improved ratchet wrench having improved mechanical advantages, which is provided with a split housing, a top arm carried by the top housing segment of the split housing and a bottom arm cooperating with the bottom housing segment of the split housing, the arms also provided with separate ratchet mechanisms for selectively engaging the teeth of a ratchet drum rotatably positioned inside the split housing and carrying a pair of oppositely-disposed side bevel gears rotatably mounted on a shaft across a diameter of the ratchet drum, the top housing segment further carrying a top bevel gear which meshes with the side bevel gears and a drive bevel gear rotatably cooperating with the bottom housing segment and also meshing with the side bevel gears and having a socket drive extending from the bottom housing, the side bevel gears and ratchet drum cooperating with the handles to effect a clockwise or counter-clockwise rotation of the socket drive when the ratchet mechanisms are in a selected first or second position and the handles are manipulated away from each other and toward each other in sequence.

Still another object of the invention is to provide a double handle ratchet wrench having a pair of housing segments joined by a split ring and a pair of handles cooperating with the respective housing segments with a ratchet means in each handle, the ratchet wrench further provided with a ratchet drum having a pair of spaced idler bevel gears mounted on a shaft in the interior thereof, a bottom bevel gear engaging the spaced idler bevel gears and carrying a socket drive extending outside the lower housing and a top bevel gear spaced from the bottom bevel gear and also engaging the idler bevel gears, the wrench further including pivoting handle lock means for selectively securing the handles together and operating the ratchet wrench in conventional fashion in one embodiment and manipulating the handles both toward and away from each other for each selected position of the ratchet means on each handle, to drive the socket drive in either direction, in another, more efficient embodiment of the invention.

SUMMARY OF THE INVENTION

These and other objects of the invention are provided in a ratchet wrench having a split housing, the housing elements of which are interconnected in rotatable relationship by a snap ring, the top and bottom segments of the housing each incorporating a handle to effect rotation of the housing segments. A hollow ratchet drum provided with external teeth is situated inside the housing elements and ratchet means are provided on the top of the upper handle and the bottom of the lower handle to selectively engage the teeth on the ratchet drum. A pair of side bevel gears are rotatably mounted on a horizontal drum shaft secured in the interior of the ratchet drum and a top bevel gear is positioned inside the top housing segment and extends inside the ratchet drum to engage the shaft-mounted side bevel gears. A fourth bevel gear is rotatably provided inside the bottom housing segment and also engages the side bevel gears, the fourth bevel gear also carrying a socket drive extending through the bottom housing for attachment to a socket. A rotatably operated handle lock is provided in cooperation with the upper and lower handles to selectively secure the handles together in one embodiment of the invention and to permit the handles to be manipulated alternately toward and away from each other to rotate the socket drive in the clockwise and counter-clockwise direction in another embodiment, depending upon the position of the respective ratchet means on the handles.

BRIEF DESCRIPTION OF THE DRAWING

The invention will be better understood by reference to the accompanying drawings, wherein.

DESCRIPTION OF THE PREFERRED EMBODIMENTS

Figure 1:
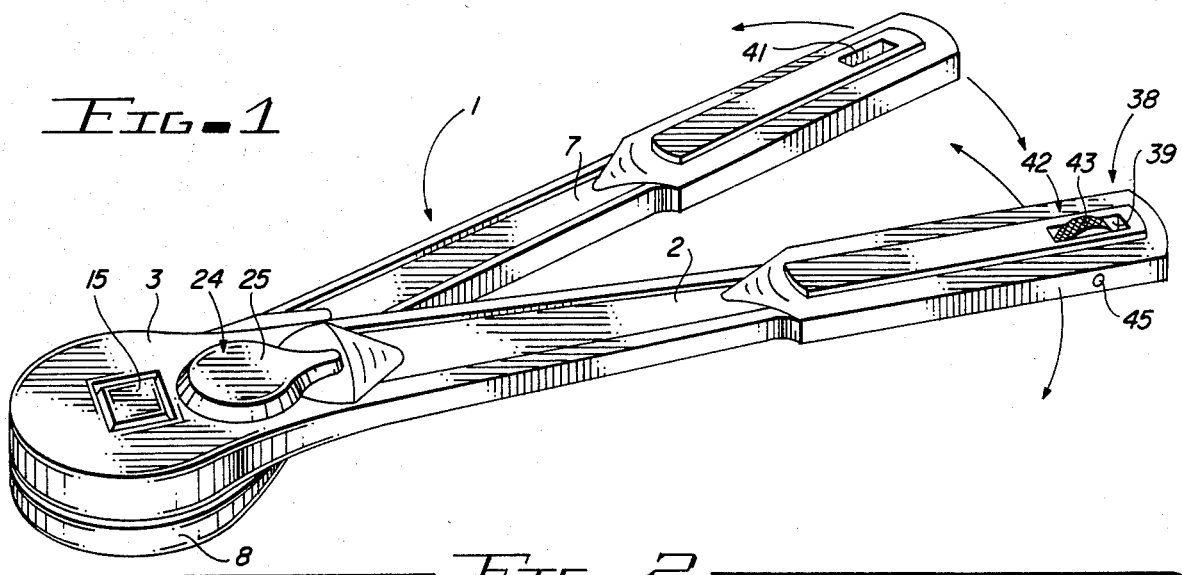
FIG. 1 is a perspective view of the ratchet wrench of this invention, with the handles in unlocked configuration.
Figure 2:
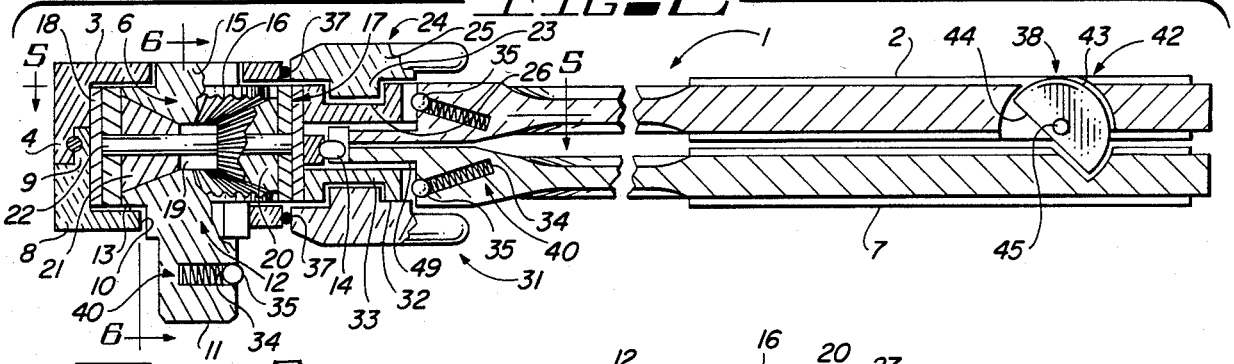
FIG. 2 is a side sectional view of the ratchet wrench illustrated in FIG. 1, with the handles in locked configuration.

Referring initially to FIGS. 1 and 2 of the drawing, in a preferred embodiment the ratchet wrench of this invention is generally illustrated by reference numeral 1 and includes a top handle 2, cooperating with a top housing 3 and a bottom handle 7 cooperating with a bottom housing 8. In a most preferred embodiment of the invention the top handle 2 is integrally formed with the top housing 3 and the bottom handle 7 is similarly shaped or cast with the bottom housing 8. A handle lock 38 is illustrated in unlocked configuration in FIG. 1 and serves to secure the top handle 2 and the bottom handle 7 together in the position illustrated in FIG. 2, as hereinafter described. A top ratchet 24 is fitted to the top handle 2 at the point where the top handle 2 joins the top housing 3 and a bottom ratchet 31 is similarly provided on the bottom handle 7 and bottom housing 8. As further illustrated in FIG. 2, a socket drive 11, incorporating a ball 35 and bias spring 34, located in a ball seat 40, projects from the bottom housing 8 through a drive aperture 10 in the bottom housing 8, to facilitate attachment of conventional sockets to the ratchet wrench 1.

Referring again to FIG. 1, when the handle lock 38 is manipulated as hereinafter described, the top handle 2 and bottom handle 7 are rendered rotatable in either a counter-clockwise or a clockwise direction with respect to each other. However, it will be appreciated that under circumstances where the top ratchet 24 is adjusted to a first position and the bottom ratchet 31 to the opposite position, then the top handle 2 and bottom handle 7 cannot be moved in alternating arcs, but only opposing circles, in a nonfunctional mode. Rotation of the top handle 2 and bottom handle 7 alternately away from each other and towards each other effects a rotation of the socket drive 11 in the counter-clockwise direction, for a selected corresponding position of the top ratchet 24 and bottom ratchet 31, as hereinafter described. Similarly, movement of the top handle 2 and bottom handle 7 alternately away and toward each other causes a clockwise rotation of the socket drive 11 for an alternative correlative position of the top ratchet 24 and bottom ratchet 31.

Figure 5:
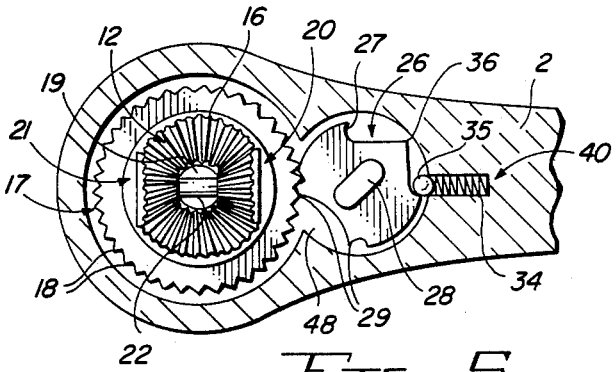
FIG. 5 is a top sectional view of the ratchet wrench bottom housing and internal working parts, taken along line 5—5 in FIG. 2, which extends through the top housing above the ratchet drum, around the top bevel gear and beneath the top ratchet plate and across the ball seat in the top handle.
Figure 6:
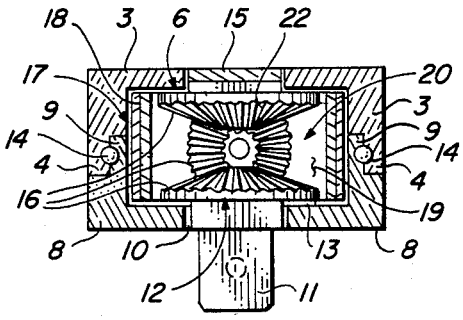
FIG. 6 is a sectional view of the ratchet housing and internal working parts, taken along lines 6—6 in FIG. 2 and extending through the top bevel gear stop, around the outer drum bevel gear and through the drive aperture in the bottom housing.

Referring now to FIGS. 2, 5 and 6 of the drawing, in a most preferred embodiment of the invention the top housing 3 and bottom housing 8 are rotatably joined by a housing snap ring 14, situated in matching snap ring grooves (not illustrated) formed in the bottom housing flange 9 and top housing flange 4, as illustrated in FIGS. 2 and 6. Disengagement of the housing snap ring 14 from the bottom housing flange 9 and the top housing flange 4 is effected by rotating the top handle 2 away from the bottom handle 7 and engaging the elongated ends of the housing snap ring 14 with a suitable tool. A generally cylindrically-shaped hollow ratchet drum 17 is disposed inside the top housing 3 and bottom housing 8 and is provided with a plurality of longitudinally oriented ratchet drum teeth 18 on the exterior surface thereof. The ratchet drum 17 is open at the top and bottom and carries a horizontally disposed drum shaft 22 across the center diameter thereof, with an inner drum bevel gear 20 and an outer drum bevel gear 21 rotatably mounted on the drum shaft 22 in facing relationship and located adjacent the interior wall of the ratchet drum 17, as illustrated. A top bevel gear 6 is situated inside the top housing 3 by means of a stop 15, tightly fitted in a square opening in the top housing 3, to facilitate replacement of the top bevel gear 6, as illustrated in FIGS. 1 and 2 and the top bevel gear 6 engages both the inner drum bevel gear 20 and the outer drum bevel gear 21. A drive bevel gear 12, carrying a socket drive 11, is rotatably disposed inside the ratchet drum 17 adjacent the inside bottom surface of the bottom housing 8. In a most preferred embodiment of the invention the drive bevel gear 12 is provided with a bushing 13, which cooperates with the inside bottom surface of bottom housing 8 to facilitate a smooth rotation of the drive bevel gear 12 and the socket drive 11 with respect to the bottom housing 8. The bushing 13 can be fabricated of such materials as copper, "Teflon", "Nylon", or like materials, according to the knowledge of those skilled in the art. As illustrated in FIGS. 2 and 5, the top bevel gear 6 engages both the inner drum bevel gear 20 and the outer drum bevel gear 21 from the top, while the drive bevel gear 12, situated at the opposite end of the ratchet drum 17, engages the inner drum bevel gear 20 and the outer drum bevel gear 21 from the bottom, as illustrated. The top bevel gear 6, drive bevel gear 12, inner drum bevel gear 20 and outer drum bevel gear 21 are provided with well defined bevel gear teeth 16, as illustrated, in order to facilitate efficient meshing during rotation. As further illustrated in FIGS. 2 and 5, a grease cavity 19 is provided inside the ratchet drum 17, in order to facilitate lubrication of the top bevel gear 6, drive bevel gear 12, inner drum bevel gear 20 and outer drum bevel gear 21 during rotation. In a most preferred embodiment of the invention the oppositely-disposed inner drum bevel gear 20 and outer drum bevel gear 21 are smaller than either the top bevel gear 6 or the drive bevel gear 12, in order to reduce the thickness and weight requirements of the top housing 3 and bottom housing 8.

Figure 4:
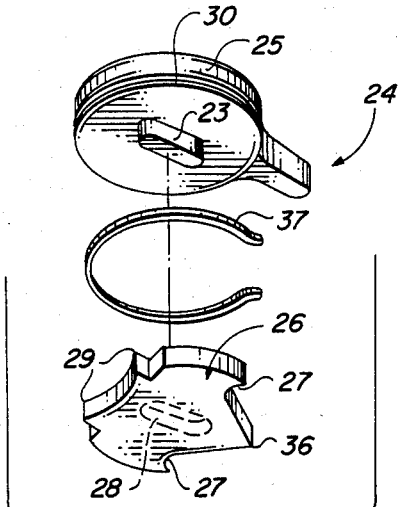
FIG. 4 is a perspective exploded view of the ratchet wrench top ratchet mechanism.

Referring now to FIGS. 2 and 4 and initially to FIG. 2, the top ratchet 24 and bottom ratchet 31 are illustrated in section, with the top ratchet 24 further illustrated in FIG. 4 and having a top ratchet housing 25 and a top ratchet pawl 26 pivotally seated in a top handle seat 48. It will be appreciated that the top ratchet 24 and bottom ratchet 31 are identical in construction. The top ratchet pawl 26 is provided with a pawl slot 28, which registers with a plate tab 23, projecting from the bottom of the top ratchet plate 25. The top ratchet pawl 26 is shaped to define a pair of spaced pawl shoulders 29, for selectively engaging the ratchet drum teeth 18 of the ratchet drum 17, respectively, as illustrated in FIG. 5. Pawl flanges 27, spaced by a flange divider 36, serve to engage the ball 35, biased into position by the spring 34, located in the ball seat 40, in order to maintain the top ratchet pawl 26 in a desired engaging position with respect to the ratchet drum teeth 18 and to facilitate a ratcheting action, as hereinafter set forth. Similarly, the bottom ratchet 31 includes a bottom ratchet plate 32 and a bottom ratchet pawl 33, which is shaped in the same configuration as the top ratchet pawl 26 and includes spaced pawl shoulders 29 for engagement with the ratchet drum teeth 18 in the ratchet drum 17, and a ball 35, biased in a ball seat 40 by a spring 34. As in the case of the top ratchet 24, the second spring 34 serves to bias the ball 35 against the pawl flanges 27, separated by a flange divider 36, in the bottom ratchet pawl 33, in order to maintain the bottom ratchet pawl 33 in the desired position, once the bottom ratchet pawl 33 is manipulated in the bottom handle seat 49 by thumb or finger pressure applied against the bottom ratchet plate 32. In a preferred embodiment of the invention the top ratchet plate 25 is rotatably secured to the top handle 2 and the bottom ratchet plate 32 to the bottom handle 7, by means of a ratchet snap ring 37, respectively, which engages the plate grooves 30, in the top ratchet plate 25 and bottom ratchet plate 32, and cooperating grooves in the top handle 2 and bottom handle 7 (not illustrated), respectively.

Figure 3:
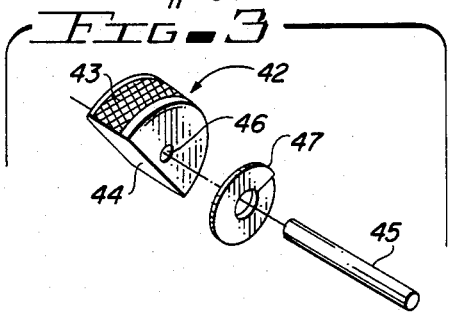
FIG. 3 is a perspective, exploded view of the ratchet wrench handle lock.

As illustrated in FIGS. 1–3 and as heretofore noted, the top handle 2 and bottom handle 7 are maintained in alignment by means of a handle lock 38, which includes a handle slot 41, located near the extending end of the bottom handle 7 and a matching locking element slot 39, located in the top handle 2. A locking element 42 is designed to register with the locking element slot 39 and is rotatably secured inside the locking element slot 39 by means of a pin 45. A tension washer 47 is also provided on the pin 45 in order to bias the locking element 42 in a selected orientation in the locking element slot 39. The locking element 42 is provided with an arcuate face 43, which is truncated by a flat face 44, terminating the arcuate face 43 beneath the pin aperture 46. When the flat face 44 is aligned with the bottom surface of the top handle 2, the top handle 2 and the bottom handle 7 can be separately manipulated, as illustrated in FIG. 1. However, when the top handle 2 and bottom handle 7 are aligned and the locking element 42 is rotated on the pin 45 such that a portion of the arcuate face 43 extends into the handle slot 41, the top handle 2 and bottom handle 7 are locked together and must be manipulated in concert.

In operation, the ratchet wrench 1 of this invention is utilized as follows. Referring to FIGS. 1, 2 and 5 when the handle lock 38 is manipulated to the position illustrated in FIG. 1, where the locking element 42 is pivotally recessed inside the top handle 2, the top handle 2 and bottom handle 7 can be separately manipulated, as illustrated in FIG. 1. Furthermore, reviewing FIG. 1, when the bottom ratchet pawl 33 is manipulated in the bottom handle seat 49 to a first position and when the top ratchet pawl 26 is manipulated to a corresponding first position in the top handle seat 48 as illustrated in FIG. 5, the corresponding ones of the respective pawl shoulders 29 of the top ratchet pawl 26 and bottom ratchet pawl 33 each engage two of the ratchet drum teeth 18 in the ratchet drum 17, to facilitate a counter-clockwise rotation of the ratchet drum 17, the drive bevel gear 12 and the socket drive 11, when the top handle 2 and bottom handle 7 are sequentially rotated toward and away from each other as indicated by the two sets of arrows. This drive sequence occurs since an initial rotation of the top handle 2 away from the bottom handle 7 results in the top pawl 26 freely ratcheting against the ratchet drum teeth 18, while the bottom ratchet pawl 33 engages a pair of the ratchet drum teeth 18 in drive configuration and causes the ratchet drum 17 to rotate in the counter-clockwise direction at the same rotational speed as the bottom handle 7. Since the fixed top bevel gear 6 is in engagement with the freely rotating inner drum bevel gear 20 and outer drum bevel gear 21, then rotation of the drive bevel gear 12 and the socket drive 11 is facilitated in the counter-clockewise direction responsive to clockwise rotation of the top handle 2. When the top handle 2 and bottom handle 7 are moved toward each other in the direction of the inside arrows, the top ratchet pawl 26 engages a pair of the ratchet drum teeth 18, while the bottom ratchet pawl 33 freely ratchets against the ratchet drum teeth 18. This action causes the top bevel gear 6, the ratchet drum 17, the drive bevel gear 12 and the socket drive 11 to rotate in the counter-clockwise direction at a speed corresponding to the rotational speed of the top handle 2, since the bottom handle 7 is now freely rotating, due to the free ratcheting action of the bottom ratchet pawl 33 on the ratchet drum teeth 18. Under these circumstances, the inner drum bevel gear 20 and outer drum bevel gear 21 are not driven by the top bevel gear 6 to rotate on the drum shaft 22, but instead, are immobile in the rotating ratchet drum 17, because the ratchet drum 17 is rotating with the top handle 2 and the top bevel gear 6. Similarly, movement of the bottom ratchet pawl 33 in the bottom handle seat 49 to engage the opposite one of pawl shoulders 29 with the ratchet drum teeth 18 and a corresponding manipulation of the top ratchet pawl 26 in the top handle seat 48, to the position opposite to that illustrated in FIG. 5, effects a clockwise rotation of the ratchet drum 17 and the socket drive 11 when the top handle 2 and the bottom handle 7 are alternately manipulated toward and away from each other.

It will be appreciated that a particularly efficient mechanical advantage is apparent in the mode of operation wherein the inner drum bevel gear 20 and outer drum bevel gear 21 are driven by the top bevel gear 6 and operate to drive the drive bevel gear 12. This occurs, for example, when one of the pawl shoulders 29 of the top ratchet pawl 26 is freely ratcheting against the ratchet drum teeth 18 of the ratchet drum 17, allowing the top handle 2 and top bevel gear 6 to rotate at the same rotational speed as the bottom handle 7 and the ratchet drum 17, but in a different direction of rotation from that of the bottom handle 7 and the ratchet drum 17, when the top ratchet pawl 26 is in the configuration illustrated in FIG. 5 and the handles are moved away from each other as illustrated by the outside arrows in FIG. 1. This action causes the inner drum bevel gear 20, outer drum bevel gear 21, drive bevel gear 12 and socket drive 11 to turn at the combined speed of the two handles, since the bevel gear teeth 16 of the inner drum bevel gear 20 and the outer drum bevel gear 21 are engaged with the bevel gear teeth 16 of the top bevel gear 6. This mechanical advantage is therefore due to the rotation of the inner drum bevel gear 20, outer drum bevel gear 21 and the drive bevel gear 12, as driven by the top bevel gear 6 by clockwise rotation of the top handle 2 and the corresponding opposite rotation of the bottom handle 7, which drives the ratchet drum 17.

It will be appreciated by those skilled in the art that in addition to the mechanical advantage achieved in the ratchet wrench 1 due to the combination of a direct drive effect with a gearing boost, another particular advantage is realized, in that for each common position of the top ratchet pawl 26 in the top ratchet 24 and the bottom ratchet pawl 33 in the bottom ratchet 31, movement of the top handle 2 and bottom handle 7 in either rotational direction effects a rotation of the socket drive 11 in one direction only. Accordingly, nuts which are loosely threaded on bolts in cramped places can be engaged by a socket of appropriate size inserted on the socket drive 11 and maintained in position by operation of the ball 25 and spring 34, and the nut can be either loosened or tightened, as desired, much faster than is possible with a conventional ratchet wrench, without the necessity of manipulating the nut by hand. Furthermore, considerable torque can be applied to the top handle 2 and bottom handle 7 to loosen or tighten a nut without stressing the workstock carrying the subject bolt and nut, since two handles are used to apply the requisite pressure, instead of one.

It will further be recognized that the ratchet wrench 1 can be used to good advantage in loosening very tight nuts or tightening such nuts to extreme pressure by rotating the top handle 2 and bottom handle 7 with respect to each other and applying selective clockwise or counter-clockwise pressure simultaneously on both handles at any position of the top ratchet 24 and bottom ratchet 31. This configuration allows considerable torque to be applied for loosening or tightening purposes.

Other advantages of the ratchet wrench 1 of this invention will be apparent to those skilled in the art, and while the preferred embodiments of the invention have been described above, it will be recognized and understood that various modifications may be made therein, and the appended claims are intended to cover all such modifications which may fall within the spirit and scope of the invention.

Having described my invention with the particularity set forth above, what is claimed is:

1. A ratchet wrench comprising:

(a) a top housing and a top handle carried by said top housing;

(b) a bottom housing in rotatable cooperation with said top housing and a bottom handle carried by said bottom housing;

(c) a ratchet drum having a hollow interior and open at both ends, said ratchet drum rotatably located inside said top housing and said botton housing and drum teeth provided on the external surface of said ratchet drum;

(d) a shaft fixedly spanning an inside diameter of said ratchet drum and a pair of drum bevel gears rotatably mounted on said shaft in oppositely-disposed relationship;

(e) a top bevel gear removably disposed in said top housing and engaging said drum bevel gears;

(f) a drive bevel gear rotatably deployed in said bottom housing opposite and spaced from said top bevel gear and engaging said drum bevel gears and a socket drive carried by said drive bevel gear and extending through said bottom housing; and (g) first ratchet means carried by said top housing and said top handle and second ratchet means carried by said bottom housing and said bottom handle, said first ratchet means and said second ratchet means selectively cooperating with said drum teeth in said ratchet drum, whereby engagement of said drum teeth in a selected orientation by said first ratchet means and said second ratchet means causes rotation of said ratchet drum in a selected direction and rotation of said top bevel gear and selective rotation of said drum bevel gears to drive said drive bevel gear responsive to rotatable manipulation of said top handle and said bottom handle.

2. The ratchet wrench of claim 1 wherein said first ratchet means is mounted on the top of said top handle and said second ratchet means is mounted on the bottom of said bottom handle.

3. The ratchet wrench of claim 1 wherein said top housing is integrally formed with said top handle and said bottom housing is integrally formed with said bottom handle.

4. The ratchet wrench of claim 1 further comprising a first slot in said bottom handle, a second slot in said top handle and locking element means pivotally disposed in said second slot, said locking element means selectively pivotable to an extended position partially rotated into said first slot when said first slot is in registration with said second slot, for selectively locking said top handle and said bottom handle together in a first use mode and releasing said top handle and said bottom handle for separate rotational manipulation of said top handle and said bottom handle in a second use mode and wherein:

(a) said first ratchet means is mounted on the top of said top handle and said second ratchet means is mounted on the bottom of said bottom handle;

(b) said top housing is integrally formed with said top handle and said bottom housing is integrally formed with said bottom handle.

5. The ratchet wrench of claim 1 further comprising snap ring means cooperating with said top housing and said bottom housing for rotatably securing said top housing to said bottom housing.

6. The ratchet wrench of claim 1 further comprising snap ring means cooperating with said top housing and said bottom housing for rotatably securing said top housing to said bottom housing, and wherein:

(a) said first ratchet means is mounted on the top of said top handle and said second ratchet means is mounted on the bottom of said bottom handle; and (b) said top housing is integrally formed with said top handle and said bottom housing is integrally formed with said bottom handle.

7. The ratchet wrench of claim 6 further comprising a first slot in said bottom handle, a second slot in said top handle and locking element means pivotally disposed in said second slot for selectively locking said top handle and said bottom handle together in a first use mode and releasing said top handle and said bottom handle for separate rotational manipulation of said top handle and said bottom handle in a second use mode.

8. The ratchet wrench of claim 1 further comprising a first slot in said bottom handle, a second slot in said top handle and locking element means pivotally disposed in said second slot, said locking element means selectively pivotable to an extended position partially rotated into said first slot when said first slot is in registration with said second slot, for locking said top handle and said bottom handle together.

9. The ratchet wrench of claim 1 further comprising bushing means positioned between said drive bevel gear and said bottom housing.

10. The ratchet wrench of claim 1 further comprising snap ring means cooperating with said top housing and said bottom housing for rotatably securing said top housing to said bottom housing and bushing means positioned between said drive bevel gear and said bottom housing and wherein:

(a) said first ratchet means is mounted on the top of said top handle and said second ratchet means is mounted on the bottom of said bottom handle;

(b) said top housing is integrally formed with said top handle and said bottom housing is integrally formed with said bottom handle; and (c) lock means further comprising a first slot in said bottom handle, a second slot in said top handle and locking element means pivotally disposed in said second slot, said locking element means selectively pivotable to an extended position partially rotated into said first slot when said first slot is in registration with said second slot, for locking said top handle and said bottom handle together.

11. The ratchet wrench of claim 10 wherein said locking element means is substantially in the shape of a truncated wheel and further comprising tensioning means positioned between said truncated wheel and said top handle in said second slot for biasing said truncated wheel in a selected orientation.

12. The ratchet wrench of claim 1 wherein said first ratchet means further comprises a first ratchet pawl means slidably positioned in said top handle and a first ratchet plate in rotatable cooperation with said top housing and engaging said first ratchet pawl means and said second ratchet means further comprises a second ratchet pawl means slidably positioned in said bottom handle and a second ratchet plate in rotatable cooperation with said bottom housing and engaging said second ratchet pawl means, whereby selective manipulation of said first ratchet plate and said second ratchet plate causes said first ratchet pawl means and said second ratchet pawl means, respectively, to selectively engage said drum teeth on said ratchet drum.

13. The ratchet wrench of claim 12 further comprising first ratchet snap ring means in cooperation with said first ratchet plate and said top handle and second ratchet snap ring means in cooperation with said second ratchet plate and said bottom handle for securing said first ratchet plate and said second ratchet plate to said top handle and said bottom handle, respectively.

14. The ratchet wrench of claim 1 further comprising a first slot in said bottom handle, a second slot in said top handle and locking element means pivotally disposed in said second slot, said locking element means selectively pivotable to an extended position partially rotated into said first slot when said first slot is in registration with said second slot, for selectively locking said top handle and said bottom together in a first use mode and releasing said top handle and said bottom handle for separate rotational manipulation of said top handle and said bottom handle in a second use mode and wherein said first ratchet means further comprises a first ratchet pawl means slidably postioned in said top handle and a first ratchet plate in rotatably cooperation with said top housing and engaging said first ratchet pawl means and said second ratchet means further comprises a second ratchet pawl means slidably positioned in said bottom handle and a second ratchet plate in rotatable cooperation with said bottom housing and engaging said second ratchet pawl means, whereby selective manipulation of said first ratchet plate and said second ratchet plate causes said first ratchet pawl means and said second ratchet pawl means to selectively engage said drum teeth on said ratchet drum.

15. The ratchet wrench of claim 14 wherein said top is integrally formed with said top handle, said bottom housing is integrally formed with said bottom handle, said first ratchet means is mounted on the top of said top handle and said second ratchet means is mounted on the bottom of said bottom handle and further comprising:

(a) snap ring means cooperating with said top housing and said bottom housing for rotatably securing said top housing to said bottom housing; and (b) bushing means positioned between said drive bevel gear and said bottom housing.

16. A double handle ratchet wrench comprising:

(a) a top housing and a top handle integrally formed with said top housing;

(b) a bottom housing in rotatable cooperation with said top housing and a bottom handle integrally formed with said bottom housing;

(c) a generally cylindrically shaped ratchet drum rotatably disposed in said top housing and said bottom housing, said ratchet drum open at both ends and having a hollow interior and drum teeth provided in longitudinal orientation on the external surface of said ratchet drum;

(d) a shaft fixedly spanning the diameter of said ratchet drum at a point substantially equidistant from each of said ends;

(e) a pair of drum bevel gears rotatably mounted on said shaft in spaced, facing relationship;

(f) a top bevel gear removably engaging said top housing and engaging said drum bevel gears;

(g) a drive bevel gear rotatably positioned in said bottom housing and engaging said drum bevel gears, said drive bevel gear facing and spaced from said top bevel gear; and (h) first ratchet means cooperating with said top housing and a first ratchet pawl in said first ratchet means, said first ratchet pawl in selective engagement with said drum teeth in said ratchet drum and second ratchet means cooperating with said botton housing and a second ratchet pawl in said second ratchet means, said second ratchet pawl in selective engagement with said drum teeth in said ratchet drum, whereby engagement of said drum teeth by said first ratchet pawl and said second ratchet pawl in a selected orientation causes rotation of said ratchet drum in a selected direction and rotation of said top bevel gear and selective rotation of said drum bevel gears to drive said drive bevel gear responsive to rotatable manipulation of said top handle and said bottom handle.

17. The double handle ratchet wrench of claim 16 further comprising a first slot in said bottom handle, a second slot in said top handle and locking element means pivotally disposed in said second slot, said locking element means selectively pivotable to an extended position partially rotated into said first slot when said first slot is in registration with said second slot, for locking said top handle and said bottom handle together.

* * * * *